US005195016A

United States Patent [19]

Powers

[11] Patent Number: 5,195,016

[45] Date of Patent: Mar. 16, 1993

[54] PHOTOELECTRIC LOAD CONTROL SYSTEM

[75] Inventor: John J. Powers, East Weymouth, Mass.

[73] Assignee: Dark to Light, Inc., Pembroke, Mass.

[21] Appl. No.: 905,153

[22] Filed: Jun. 25, 1992

Related U.S. Application Data

[63] Continuation of Ser. No. 808,079, Dec. 11, 1991, abandoned, which is a continuation of Ser. No. 688,371, Apr. 19, 1991, abandoned, which is a continuation of Ser. No. 416,359, Oct. 3, 1989, abandoned.

[51] Int. Cl.[5] ..... H01H 47/24

[52] U.S. Cl. ..... 361/175; 315/159; 323/351

[58] Field of Search ..... 323/237, 242, 271, 299, 323/320, 326, 327, 351, 902, 906; 361/139, 143, 152-156, 173-177, 189, 190; 315/150, 159

[56] References Cited

U.S. PATENT DOCUMENTS

| | | | |
|---|---|---|---|
| 3,128,412 | 4/1964 | Abromaitis | 315/159 |
| 3,231,787 | 1/1966 | Knudson | 361/175 |
| 3,660,730 | 5/1972 | Mason | 361/190 |
| 3,878,439 | 4/1975 | Crozier | 361/175 |
| 4,399,483 | 8/1983 | Phelan | 361/152 |
| 4,458,290 | 7/1984 | Miyashita | 361/175 |
| 4,603,370 | 7/1986 | Imazeki et al. | 361/155 |
| 4,665,321 | 5/1987 | Chang et al. | 315/159 |
| 5,132,596 | 7/1992 | Walters et al. | 315/159 |

*Primary Examiner*—Steven L. Stephan
*Assistant Examiner*—Jeffrey Sterrett
*Attorney, Agent, or Firm*—Iandiorio & Dingman

[57] ABSTRACT

A photoelectric load control system for applying a.c. power to a street light as a function of ambient light level includes switching means for selectively applying a.c. power to a street light for turning the street light on and off; a trigger circuit having two states, a first state which actuates the switching means to turn on the street light and a second state which actuates the switching means to turn off the street light; means for biasing the trigger circuit into one of the states; and photoelectric sensing means for varying the bias on the trigger circuit to drive it into the other state in response to the ambient light level sensed by the photoelectric sensing means.

13 Claims, 2 Drawing Sheets

PHOTOELECTRIC LOAD CONTROL SYSTEM

Figure 1:
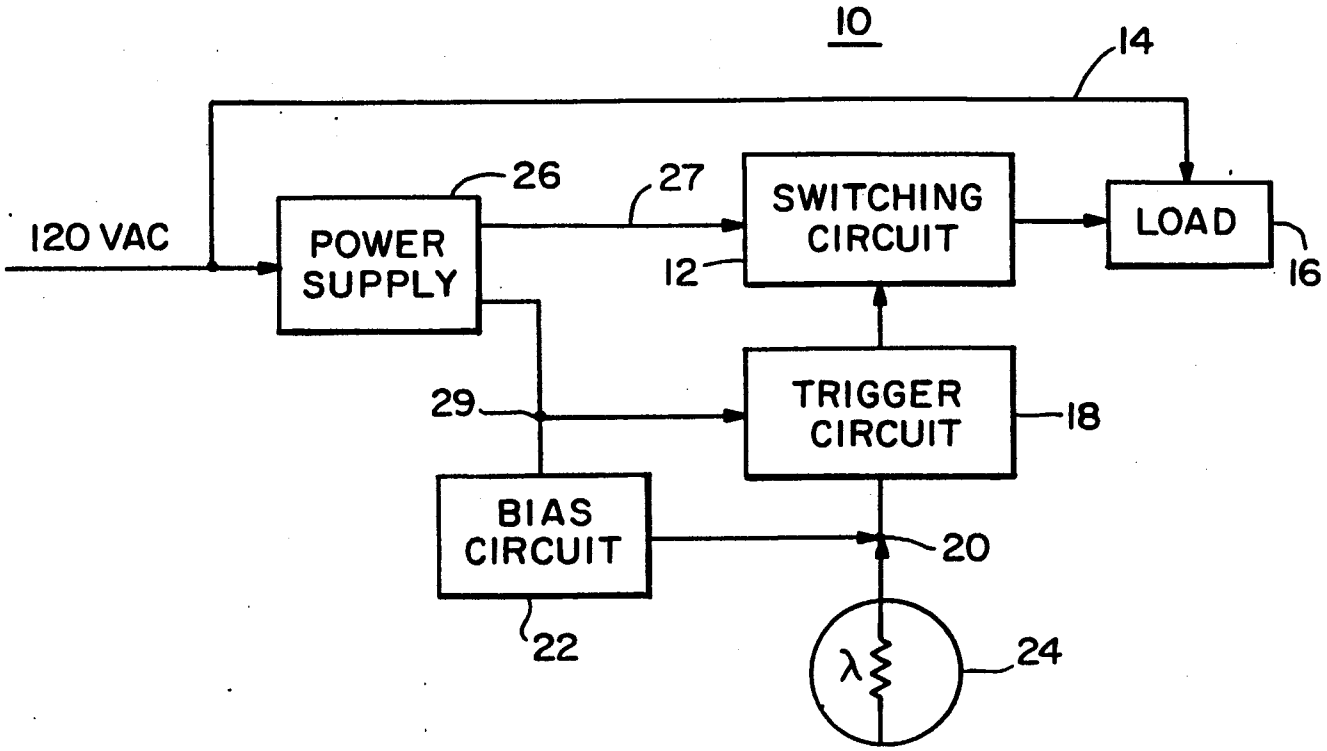

This is a continuation of application Ser. No. 07/808,079 filed Dec. 11, 1991, now abandoned which is a continuation of application Ser. No. 07/688,371, filed Apr. 19, 1991, now abandoned which is a continuation of application Ser. No. 07/416,359, filed Oct. 3, 1989, now abandoned.

FIELD OF INVENTION

This invention relates to a photoelectric load control system which controls the energizing and de-energizing of a load, such as an outdoor lamp, in response to ambient light levels.

BACKGROUND OF INVENTION

The majority of outdoor lighting, such as street lamps, are provided with individual controllers which are designed to turn the lamps on at dusk in response to a particular ambient light level, and turn off the lamps at dawn in response to yet another ambient light level. Such controllers are typically photoelectric controllers which are mounted on the lamp housing.

Typical photoelectric controllers now in use exhibit failure rates approaching ten percent. Since photoelectric controllers are generally designed to fail with the load energized or "on", this high failure rate translates into a tremendous amount of wasted electricity. In addition, lamp owners report average labor costs for replacing defective controllers of approximately $50 per unit. Such high replacement cost for a $3 or $4 dollar controller can no longer be tolerated.

Present-day photoelectric controllers exhibit such high failure rates for a number of reasons. For example, a.c. electromechanical relays exhibit a characteristic known as "chattering" as the relay's armature mechanism opens and closes repeatedly as a result of the slowly changing magnitude of the a.c. waveform. This occurs where the electromechanical relay is connected directly to a photocell and control current to the relay changes slowly as the ambient light level changes. This provides no clear, distinct on and off trip point for the contacts, and therefore the contacts arc and ultimately self-destruct.

Thermal bimetallic type controllers have also been used. Although they provide a distinct switching point, the photocell controls current through a heater. This is a slow-reacting switch which may take up to one minute to turn on a lamp or other load. Because of the heat developed in these switches, these controllers also exhibit a very high failure rate. In addition, many photocells exhibit drifting of trigger level due to excessive power dissipation in the photocell or effects from ultraviolet light.

Semiconductor elements such as SCRs have been used in an attempt to replace electromechanical relays. However, since over 100 amps of instantaneous inrush current is often developed through the switch, such a high current level tends to break down and destroy the SCR.

SUMMARY OF INVENTION

It is therefore an object of this invention to provide a photoelectric load control system which instantaneously and positively switches to the on and off state.

It is a further object of this invention to provide such a control system in which the on/off trip point is controlled electronically, thereby eliminating changes in the trip value due to coil resistance and contact gap changes.

It is a further object of this invention to provide such a control system in which the photocell does not overheat.

It is a further object of this invention to provide such a control system which has a fast response time.

It is a further object of this invention to provide such a control system which has a low failure rate.

It is a further object of this invention to provide a photoelectric load control system which saves wasted energy costs and replacement costs.

It is a further object of this invention to provide such a system which is less sensitive to ultraviolet light.

It is a further object of this invention to provide such a system which provides surge protection for both the control system circuit and the lamp.

This invention results from the realization that a truly effective photoelectric load control system can be achieved by providing a photocell to operate a trigger circuit which responds predictably and reliably to a preset trigger level to control an electromechanical relay to positively and quickly energize and de-energize a load.

This invention features a photoelectric load control system for applying a.c. power to a street light as a function of ambient light level. There are switching means for selectively applying a.c. power to a street light for turning the street light on and off. A trigger circuit is provided which has two states: a first state which actuates the switching means to turn on the street light and a second state which actuates the trigger means to turn off the street light. There are means for biasing the trigger circuit into one of the states and there are photoelectric sensing means for varying the bias on the trigger circuit to drive it into the other state in response to the ambient light level sensed by the photoelectric sensing means.

In a preferred embodiment the switching means is an electromechanical relay. More particularly, it may be a fast-acting d.c. relay. The trigger circuit may be a Schmitt trigger. The means for biasing may include a voltage divider circuit interconnected with the input to the trigger circuit. The photoelectric sensing means is also connected with the voltage divider circuit at the input to the trigger circuit. The trigger circuit may include a first transistor with its collector and emitter in series with the switching means and a second transistor with its collector connected to the base of the first transistor, its base connected to the photoelectric sensing circuit and the emitters of both transistors connected to a common emitter resistor. The switching circuit may include a bypass circuit for dissipating the current in the relay resulting from the collapse of the electric field in the relay coil. The trigger circuit may include a suppression circuit for suppressing regenerative oscillations caused by the switching of the relay. There may be a d.c. power supply having a full-wave pulsating d.c. output for energizing the switching means under control of the trigger circuit and a filtered d.c. output for energizing the trigger circuit and photoelectric sensing circuit. The switching means may include a resistance in series with the relay coil for limiting current amplitude and reducing the inductance to resistance (L/R) ratio to reduce switching time. The means for biasing may bias the trigger circuit to operate the switching means to turn on the street light.

DISCLOSURE OF PREFERRED EMBODIMENT

Figure 2:
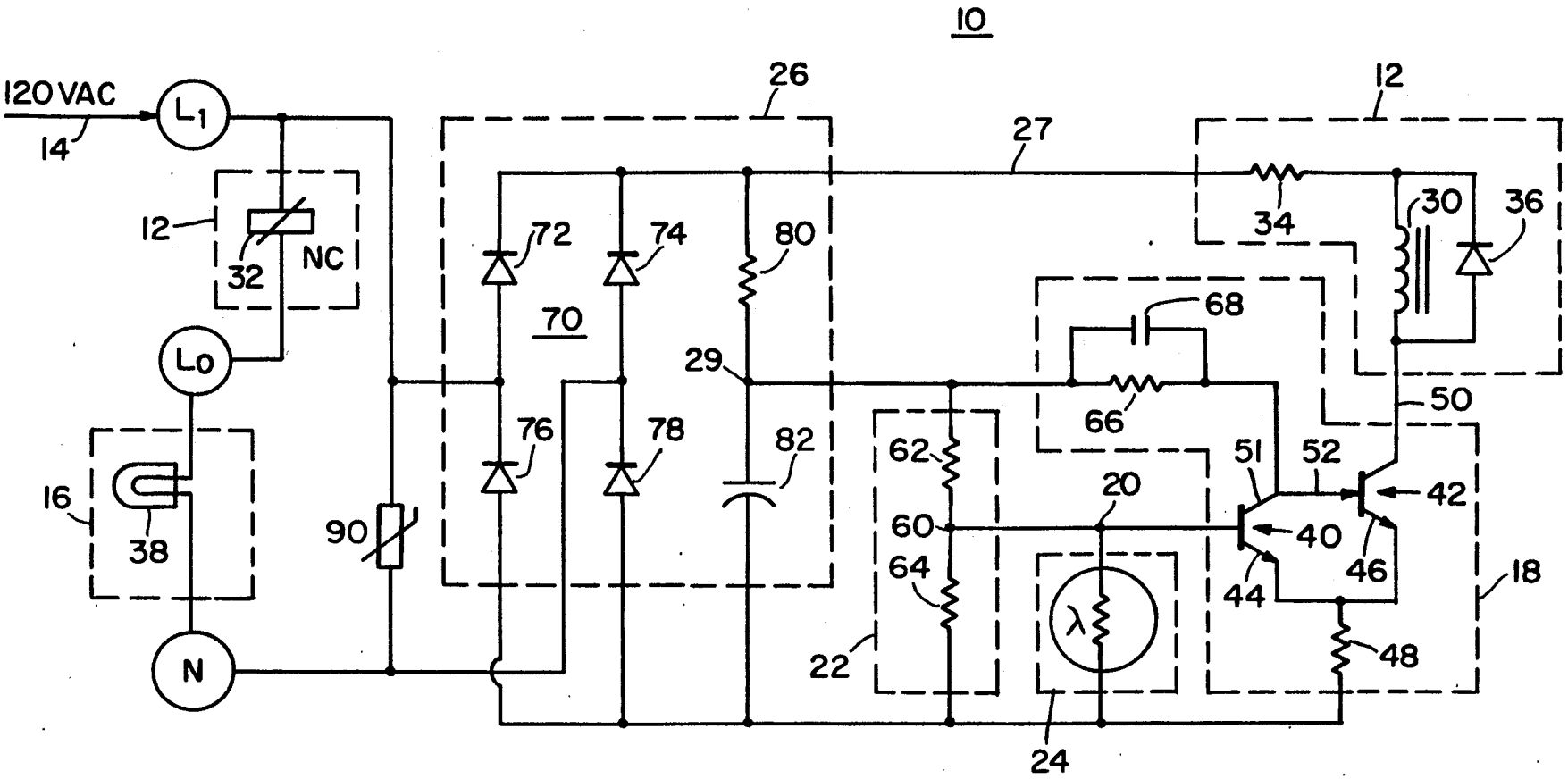

Other objects, features and advantages will occur to those skilled in the art from the following description of a preferred embodiment and the accompanying drawings, in which:

FIG. 1 is a schematic block diagram of the photoelectric load control system according to the present invention; and FIG. 2 is a more detailed schematic circuit diagram of the photoelectric load control system of FIG. 1.

The invention may be accomplished in a photoelectric load control system which applies a.c. power to a street light as a function of ambient light level. There are switching means such as an electromechanical d.c. relay for selectively applying the a.c. power, such as 120 volts, to a street light of 1000 watts tungsten or 1800 VA ballast type load. The switching means or relay turns the street light on and off. There is a trigger circuit, such as a Schmitt trigger circuit or typically some other semiconductor circuit, which has two states: a first state which actuates the relay to turn on the street light, and a second state which actuates the relay to turn off the street light. There are some means for biasing the trigger circuit into one of those states. In this disclosure the trigger circuit is biased off so that the relay is de-energized, and its normally closed contacts are thus closed to light the light. There are photoelectric sensing means such as a photoelectric cell for varying the bias on the trigger circuit to drive it into the other state in response to the ambient light level sensed by the photoelectric sensing means. Thus in this disclosure the light is on and the relay contacts are normally closed in the dark condition. When during the day there are high light levels, the photoelectric cell resistance approaches zero, the bias drops and the trigger circuit turns on. This energizes the relay, which opens the contacts and turns off the street light. Actually the trigger circuit and the means for biasing act together in the nature of a comparator: when the bias on trigger circuit is greater than some reference level the trigger circuit is in one state; when the bias is less the trigger circuit is in the other state. In one condition, when the photocell is dark and of high resistance, the trigger operates to turn on the street light. When the comparison shows that the photoelectric cell is brightly lit and of low resistance, it turns off the street light. The switching means may be a fast-acting d.c. relay which operates in 10–20 milliseconds. The means for biasing may include a voltage divider which is interconnected with the input to the trigger circuit. The photoelectric sensing means is a conventional cadmium sulfide photoelectric cell and is connected to the same input of the voltage divider which is connected to the input of the trigger circuit, so that changes in the resistance of the photoelectric cell causes variations in the bias being applied to the trigger circuit. The trigger circuit may include two transistors or other semiconductor switches, a first with its collector and emitter in series with the switching means or relay, and the second transistor with its collector connected to the base of the first transistor, and its base connected to the photoelectric sensing circuit. The emitters of both transistors are connected to a common emitter resistor. The switching circuit may further include a bypass circuit, e.g. a diode which dissipates the induced current in the relay when the electric field collapses in the relay coil. The trigger circuit may include a suppression circuit for suppressing regenerative oscillations caused by the switching of the relay. Typically this suppressor circuit includes a capacitor of a specific size to suppress low frequency, regenerative oscillations resulting from the collapsing field in the relay. The d.c. power supply includes a full-wave rectifier bridge which provides the full-wave pulsating d.c. output for energizing the switching means. That output is also reduced through a dropping resistor and filtered through a filter capacitor to provide a filtered d.c. output which is used to operate the means for biasing or voltage divider and operate the trigger circuit as well as the photoelectric cell. A resistance is provided in series with the switching circuit or relay coil to limit the current amplitude through the coil and also to reduce the inductance to resistance (L/R) ratio in order to reduce the switching time.

There is shown in FIG. 1 a photoelectric load control system 10 according to this invention including a switching circuit 12 which in a first state applies 120 volt a.c. current over line 14 to load 16, which is a street light, and in the other state cuts off the 120-volt a.c. on line 14 to load 16. Switching circuit 12 is selectively switched between its states by trigger circuit 18. Trigger circuit 18 holds switching circuit 12 in one state under the influence of the bias at point 20 provided by bias circuit 22. However, when the light level on photoelectric cell 24 changes appreciably, the bias at point 20 is changed as well so that trigger circuit 18 is triggered with a sharp, clean pulse at a particular light level to drive switching circuit 12 to switch states and turn the street light from on to off or off to on. Switching circuit 12 receives full-wave rectified pulsating d.c. power over line 27 from power supply 26, which also supplies a somewhat lower filtered d.c. voltage at point 29 to bias circuit 22 as well as to trigger circuit 18.

As shown in greater detail in FIG. 2, switching circuit 12 includes a relay coil 30 and normally closed contacts 32. A series resistor 34 acts as a limiting resistor to protect coil 30 from excess current and also acts to decrease the inductance to resistance ratio (L/R), thereby improving the operation speed of the relay. Resistor 34 is typically 4.7K ohm. Also provided in switching circuit 12 is diode 36 which acts to dissipate current in coil 30 induced by the collapsing field which might damage the semiconductors in trigger circuit 18. Load 16 includes a street light 38, having a capacity of 1000 watts tungsten or 1800 VA ballast type load. Trigger circuit 18 is generally a Schmitt trigger including two transistors 40 and 42 connected in a common emitter configuration with their emitters 44 and 46 connected to common emitter resistor 48. The collector 50 of transistor 42 is connected in series with coil 30. The base 52 of transistor 42 is connected to the collector 54 of transistor 40. The base of transistor 40 is connected at point 20 to photoelectric cell, 24 and also to the center tap 60 of bias circuit 22 which includes resistors 62 and 64. Transistors 40 and 42 are of the NPN type such as MPS-A42. Common emitter resistor 48 is typically 360 ohms; resistors 62 and 64 are 68K ohms and 15K ohms, respectively. Photocell 24 may be a cadmium sulfide type. Trigger circuit 18 also includes a 10K ohm resistor 66 which acts as a voltage divider in conjunction with common emitter resistor 48. Capacitor 68 is a 0.1uF suppression capacitor which suppresses low frequency regenerative oscillations resulting from the collapsing field in coil 30 which would otherwise continue and produce an on-off dithering by its presence on base 52 of transistor 42. Power supply 26 includes a full-wave bridge 70 including four diodes 72, 74, 76 and 78 such as 1N4004. The output of rectifier bridge 70 on line 27 is a full-wave rectified pulsating d.c. current. The power supply also provides a second output through 22K ohm dropping resistor 80, which in conjunction with 22uF, 50–63 VDC filter capacitor 82 provides at point 29 a lower, filtered, d.c. voltage which energizes voltage divider 22 and trigger circuit 18 as well as photoelectric cell 24.

In operation, with approximately 110 volts on line 27 and 35 volts at point 29, there is approximately 1.5 volts at point 20. This maintains transistor 40 in the "on" state, and thus transistor 42; is in the "off" state. This de-energizes coil 30 so that relay 12 is in the normally closed condition; thus contacts 32 are closed and light 38 is lit. It is nighttime, and the ambient light level is low. When daytime approaches and the light level increases, photoelectric cell 24, which has been in the megohm resistance range, now drops to nearly zero resistance. This pulls point 20 below the 1.5 volts almost to zero. That turns off transistor 40, which turns on transistor 42; that energizes coil 30 and so pulls up the contacts 32 to the open position. This turns off street light 38.

A varistor 90 is disposed across the a.c. input lines to protect against transients on the line due to lightning and other causes. Varistor 90 according to this invention protects not only the circuits of system 10 but also protects the street light itself since it is across the entire line.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A photoelectric load control system for applying a.c. power to a street light as a function of ambient light level, comprising:

electromagnetically-activated switching means for selectively applying a.c. power to a street light for turning the street light on and off;

a Schmitt trigger circuit having two states, a first state which actuates said switching means to turn on the street light, and a second state which actuates said switching means to turn off the street light;

said trigger circuit further including a suppression circuit for suppressing regenerative oscillations caused by the operation of said switching means;

means for biasing said trigger circuit into one of said states; and a photoelectric cell for varying the bias on said trigger circuit to bias it into the other state in response to the ambient light level sensed by said photoelectric cell wherein said trigger circuit and said photoelectric cell are commonly interconnected to a bias point of said means for biasing.

2. The photoelectric load control system of claim 1 in which said switching means is a d.c. electromechanical relay.

3. The photoelectric load control system of claim 2 in which said switching circuit includes a bypass circuit for dissipating the current in said relay resulting from the collapse of the electric field in the coil of said electromechanical relay.

4. The photoelectric load control system of claim 3 wherein said bypass circuit comprises a diode.

5. The photoelectric load control system of claim 1 in which said means for biasing includes a voltage divider circuit interconnected with the input to said trigger circuit.

6. The photoelectric load control system of claim 1 in which said trigger circuit includes a first transistor with its collector and emitter in series with said switching means and a second transistor with its collector connected to the base of said first transistor, its base connected to said photoelectric cell circuit and the emitters of both transistors are connected to a common emitter resistor.

7. The photoelectric load control system of claim 1 in which said means for biasing biases said trigger circuit to operate said switching means to turn on the street light.

8. The photoelectric load control system of claim 1 wherein said suppression circuit comprises a suppression capacitor.

9. The photoelectric load control system of claim 1 further including a d.c. power supply having a full wave pulsating d.c. output for energizing said switching means under control of said trigger circuit and a filtered d.c. output for energizing said trigger circuit and photoelectric sensing circuit.

10. The photoelectric load control system of claim 9 in which said switching means is a d.c. electromechanical relay.

11. The photoelectric load control system of claim 10 in which said switching means further includes a resistance in series with the relay coil for limiting current amplitude and reducing the switching time.

12. A photoelectric load control system for applying a.c. power to a street light as a function of ambient light level, comprising:

a d.c. electromagnetic relay for selectively applying the a.c. power to a street light for turning the street light on and off;

a Schmitt trigger circuit having two states, a first state which actuates said relay to turn on the street light, and a second state which actuates said relay to turn off the street light;

said trigger circuit further including a suppression capacitor for suppressing low frequency regenerative oscillations caused by the operation of said relay;

means for biasing said trigger circuit into one of said states; and a photoelectric cell for varying the bias on said trigger circuit to bias it into the other state in response to the ambient light level sensed by said photoelectric cell wherein said trigger circuit and said photoelectric cell are commonly interconnected to a bias point of said means for biasing.

13. A photoelectric load control system for applying a.c. power to a street light as a function of ambient light level, comprising:

a d.c. electromagnetic relay for selectively applying the a.c. power to a street light for turning the street light on and off;

a Schmitt trigger circuit having two states, a first state which actuates said relay to turn on the street light, and a second state which actuates said relay to turn off the street light;

said trigger circuit further including a suppression capacitor for suppressing low frequency regenerative oscillations caused by the changing inductance of said relay during said selective application of a.c. power to the street light;

means for biasing said trigger circuit into one of said states; and a photoelectric cell for varying the bias on said trigger circuit to bias it into the other state in response to the ambient light level sensed b said photoelectric cell wherein said trigger circuit ad said photoelectric cell are commonly interconnected to a bias point of said means for biasing.

* * * * *